US012599175B2

(12) United States Patent
Chen

(10) Patent No.: US 12,599,175 B2
(45) Date of Patent: Apr. 14, 2026

(54) ATOMIZING DEVICE, ATOMIZING ASSEMBLY, AND MANUFACTURING PROCESS OF ATOMIZING ASSEMBLY

(71) Applicant: Shenzhen Huachengda Precision Industry Co. Ltd., Shenzhen (CN)

(72) Inventor: Ping Chen, Shenzhen (CN)

(73) Assignee: Shenzhen Huachengda Precision Industry Co. Ltd., Shenzhen (CN)

( * ) Notice: Subject to any disclaimer, the term of this patent is extended or adjusted under 35 U.S.C. 154(b) by 374 days.

(21) Appl. No.: 18/224,581

(22) Filed: Jul. 21, 2023

(65) Prior Publication Data

US 2024/0108064 A1 Apr. 4, 2024

(30) Foreign Application Priority Data

Sep. 29, 2022 (CN) ..... 202211200888.4
Sep. 29, 2022 (CN) ..... 202211200890.1
Dec. 16, 2022 (CN) ..... 202211625543.3

(51) Int. Cl.
*A24F 40/46* (2020.01)
*A24F 40/485* (2020.01)
(Continued)

(52) U.S. Cl.
CPC ..... *A24F 40/46* (2020.01); *A24F 40/485* (2020.01); *A24F 40/70* (2020.01); *A24F 40/10* (2020.01)

(58) Field of Classification Search
None
See application file for complete search history.

(56) References Cited

U.S. PATENT DOCUMENTS 9,282,772 B2 3/2016 Tucker et al.
2010/0126652 A1* 5/2010 Joern ..... B29C 70/382 156/93
(Continued)

FOREIGN PATENT DOCUMENTS

CN 209518269 U 10/2019
CN 113142682 A 7/2021
(Continued)

OTHER PUBLICATIONS

First Office action of Counterpart Canadian Patent Application No. 3,207,245 issued on Aug. 16, 2024.
(Continued)

*Primary Examiner* — Cynthia Szewczyk

(57) ABSTRACT

The present invention discloses an atomizing device, an atomizing assembly, and a manufacturing process of the atomizing assembly. The atomizing assembly includes a first liquid conducting member and an electrode. The first liquid conducting member is flexible and configured for adsorbing an atomizable medium. The electrode includes a conductive electrode including a conductive area that is formed by sewing a conductive wire on the first liquid conducting member and electrically connected to a heating assembly. The conductive area of the conductive electrode of the atomizing assembly is sewn to the first liquid conducting member, the production is relatively simple and easy to implement, the electrically conductive material is fixed on the liquid conducting substrate based on the sewing principle, to form the atomizing assembly with good reliability, easy to batch production, and having good contact between the heating assembly and the liquid conducting substrate.

15 Claims, 4 Drawing Sheets

(51) Int. Cl.
*A24F 40/70* (2020.01)
*A24F 40/10* (2020.01)

(56) References Cited

U.S. PATENT DOCUMENTS

| | | | | |
|---|---|---|---|---|
| 2015/0157055 | A1 | 6/2015 | Lord | |
| 2018/0279672 | A1 | 10/2018 | Davis et al. | |
| 2020/0154784 | A1* | 5/2020 | Sebastian | A24B 15/167 |
| 2022/0279853 | A1 | 9/2022 | Huang et al. | |
| 2023/0210177 | A1 | 7/2023 | Zominy | |
| 2025/0185713 | A1 | 6/2025 | Zhou et al. | |

FOREIGN PATENT DOCUMENTS

| | | | | |
|---|---|---|---|---|
| KR | 10-2022-0023972 | A | 3/2022 | |
| KR | 10-2022-0038598 | A | 3/2022 | |
| NL | 2014019 | B1 | 10/2016 | |
| WO | 2015161459 | A1 | 10/2015 | |
| WO | WO-2021123367 | A1 * | 6/2021 | A24F 40/46 |
| WO | 2021151935 | A2 | 8/2021 | |

OTHER PUBLICATIONS

First Office action of Counterpart Canadian Patent Application No. 3,207,507 issued on Aug. 22, 2024.
Extended European Search Report of Counterpart European Patent Application No. 23187431.4 issued on Feb. 21, 2024.
Extended European Search Report of Counterpart European Patent Application No. 23187434.8 issued on Feb. 22, 2024.
Extended European Search Report of Counterpart European Patent Application No. 23187429.8 issued on Feb. 21, 2024.
Examination Report of Counterpart Indian Patent Application No. 202334050909 issued on Oct. 9, 2025.
Examination Report of Counterpart Indian Patent Application No. 202334050906 issued on Oct. 6, 2025.
Non-final Office Action of Counterpart U.S. Appl. No. 18/224,577 issued on Nov. 3, 2025.

* cited by examiner

ATOMIZING DEVICE, ATOMIZING ASSEMBLY, AND MANUFACTURING PROCESS OF ATOMIZING ASSEMBLY

CROSS REFERENCE TO RELATED APPLICATIONS

The present application claims the benefit of Chinese Patent Application Nos. 202211200888.4 and 202211200890.1 filed on Sep. 29, 2022, and 202211625543.3 filed on Dec. 16, 2022. All the above are hereby incorporated by reference in their entirety.

FIELD

The present invention relates to the technical field of atomization, and more specifically, to an atomizing device, an atomizing assembly, and a manufacturing process of the atomizing assembly.

BACKGROUND

The electric heating atomization technology is to use the electric energy to heat atomizable liquid to make it reach the boiling point to produce aerosol mixed with vapor and air. The electronic atomizing device is widely used in the field of electronic cigarette. The atomizing core is the core component of the atomizer, which is mainly composed of a liquid conducting material and a heating material.

In the atomizing device, the heating member generates heat energy due to the thermal effect of resistance when electrified to heat and evaporate the atomizable liquid. The heating member needs to be connected to an electrode to contact an external power supply device, and the electrode is made of conductive material. In order to make the electrode contact well and generate less heat, the resistance of the electrode needs to be much smaller than the resistance of the heating circuit, otherwise a relatively large resistance will be generated, and heat will be generated at the electrode connection, thereby occupying energy consumption and causing the heating member to warm up slowly.

However, due to the use characteristics in this field, the temperature of the heating member generally needs to reach the temperature required for atomization at the moment of the suction of the user, and to be quickly recovered to the room temperature when the user stops using. Therefore, the selected material of the heating member requires to be heated quickly and to dissipate the heat quickly, thus the selected heating member is relatively fine. Meanwhile, the heating member also needs to be attached to the liquid conducting member to be in a good contact with the liquid conducting material. How an extremely fine conductive heating member forms an electrode contact and a lead wire has always been a problem for the industry. Therefore, for the relatively fine filamentous heating member material, some structures and processes need to be developed to solve how to form the contact electrode and the lead wire.

In this field, welding (such as laser welding, resistance welding, or the like) is mostly used to weld the heating material and the electrode material, or the metal material is riveted and pressed, to make the surfaces of the heating material and the electrode material contact. For some extremely thin heating material, such as that with a wire diameter of 0.1 mm or less, mass production is difficult to implement, due to the difficulty of welding and the tendency to break under stress due to the fine wire diameter, and due to the difficulty of pressing during riveting due to the fine wire diameter.

SUMMARY

A technical problem to be solved by the present invention is, to provide an atomizing device, an atomizing assembly, and a manufacturing process of the atomizing assembly, in view of the defects that the connection between the electrode and the heating assembly in the prior art is difficult to assemble and process, and easy to disconnect.

A technical solution adopted by the present invention to solve the technical problem is, to provide an atomizing assembly, including a first liquid conducting member, and at least one electrode; wherein, the first liquid conducting member is flexible and configured for adsorbing an atomizable medium, and the at least one electrode includes a conductive electrode including a conductive area formed by sewing a conductive wire on the first liquid conducting member, and the conductive area is electrically connected to a heating assembly to enable the heating assembly to heat and atomize the atomizable medium on the first liquid conducting member when electrified In some embodiments, the conductive area is provided with at least one linear-shaped conductive portion exposed after sewing the conductive wire.

In some embodiments, the conductive area is arranged with several conductive portions exposed after sewing the conductive wire, and the conductive portions are dot shaped, and distributed in the conductive area; and/or, the conductive portions are linear shaped, and the conductive area includes the several conductive portions arranged side by side or in a crossed manner.

In some embodiments, the conductive electrode further includes a support layer supporting the conductive portion.

In some embodiments, the support layer is arranged between the conductive portion and the first liquid conducting member.

In some embodiments, the support layer is made of a conductive metal.

In some embodiments, a thickness of the support layer is not larger than 0.2 mm.

In some embodiments, the support layer is provided with positioning holes for the conductive wire to pass through to be sewn to the first liquid conducting member.

In some embodiments, an edge of the support layer extends to form a conductive head for electrical conduction.

In some embodiments, the conductive electrode further includes a conductive layer arranged on the conductive area.

In some embodiments, the conductive layer is made of a conductive paste or a conductive adhesive; or, the conductive layer is made of a metal sheet.

In some embodiments, the metal sheet is sewn onto the first liquid conducting member.

In some embodiments, the at least one electrode includes at least two conductive electrodes that are located on one side of the first liquid conducting member or on two sides of the first liquid conducting member.

In some embodiments, the atomizing assembly further includes a heating assembly fixed to the first liquid conducting member by sewing.

In some embodiments, the heating assembly includes a second wire that is flexible and sewn on the first liquid conducting member, the second wire is electrically conductive and electrically connected to the conductive area, and a sewing density of the heating assembly is less than a sewing density of the conductive area.

In some embodiments, the material of the second wire is the same as that of the conductive wire; or, the second wire and the conductive wire are a same wire.

An atomizing device is provided, including the atomizing assembly.

A manufacturing process of an atomizing assembly is provided, including the following steps:

providing a liquid conducting substrate that is flexible and a conductive wire that is flexible; and sewing the conductive wire onto the liquid conducting substrate to form a conductive area configured to electrically conduct an external power and a heating assembly.

In some embodiments, after a support layer is arranged on the liquid conducting substrate, the conductive area is formed by sewing on the support layer.

In some embodiments, the support layer is provided with positioning holes, and the conductive wire is sewn onto the liquid conducting substrate through the positioning holes, and positions the support layer.

In some embodiments, a conductive layer is arranged on the conductive area.

In some embodiments, the conductive layer is formed by coating or printing a conductive paste or a conductive adhesive on the conductive area; or, the conductive layer is formed by sewing a metal sheet onto the liquid conducting substrate.

In some embodiments, multiple sets of heating assemblies and electrodes are sewn on the liquid conducting substrate in a zoned manner, and then the liquid conducting substrate is cut to form the atomizing assembly respectively with the heating assembly and the electrode.

The implementation of the atomizing device, the atomizing assembly, and the manufacturing process of the atomizing assembly in the present invention provides the following beneficial effects: the conductive area of the conductive electrode of the atomizing assembly is manufactured to the first liquid conducting member in a sewing manner, the production is relatively simple and easy to implement, the electrically conductive material is fixed on the liquid conducting substrate based on the sewing principle, to form the atomizing assembly with good reliability, easy to batch production, and having good contact between the heating assembly and the liquid conducting substrate, and the problems that in the application of the flexible liquid conducting substrate such as the liquid conducting cotton, the electrode is prone to poor contact and deformation, difficult to take during assembly, and prone to disconnect after being welded, are solved.

Further, some better heating material can be applied to the heating assembly and the conductive electrode of the atomizing assembly, such as a heating material of a conductive fiber type, such as a carbon fiber, a metal fiber, or the like, due to that the conductive material of the fiber type generates heat when electrified, and, due to the fact that fine gaps exist in the fibers and the e-liquid can be conducted through the capillary action, and meanwhile, the surface area is larger, so that the contact with the e-liquid is sufficient, and atomization is more thorough.

BRIEF DESCRIPTION OF THE DRAWINGS

Subject matter of the present invention will be described in even greater detail below based on the exemplary figures. In the accompanying drawings.

DETAILED DESCRIPTION

For better understanding of the technical features, objects and effects of the present invention, the specific embodiments of the present invention will be described in detail with reference to the accompanying drawings.

An atomizing device in a preferred embodiment of the present invention includes an atomizer and a battery assembly. The atomizer includes a housing, and a liquid storage cavity and an atomizing assembly 10 that are arranged in the housing. The liquid storage cavity is configured to store an atomizable medium. The atomizing assembly 10 can adsorb the atomizable medium. When the atomizing assembly 10 is electrified by the battery assembly, the atomizable medium on the atomizing assembly 10 can be heated to generate aerosols to flow out.

Figure 1:
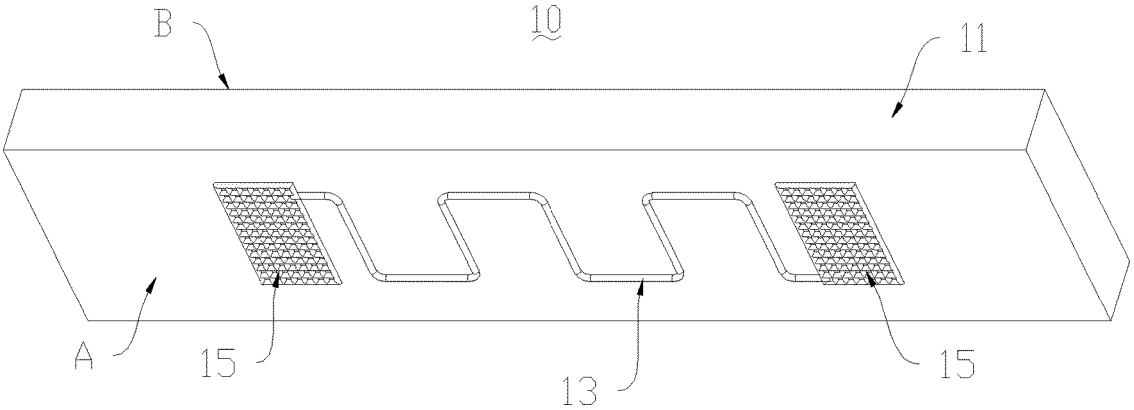
FIG. 1 is a three-dimensional structural diagram of an atomizing assembly in an embodiment of the present invention.
Figure 2:
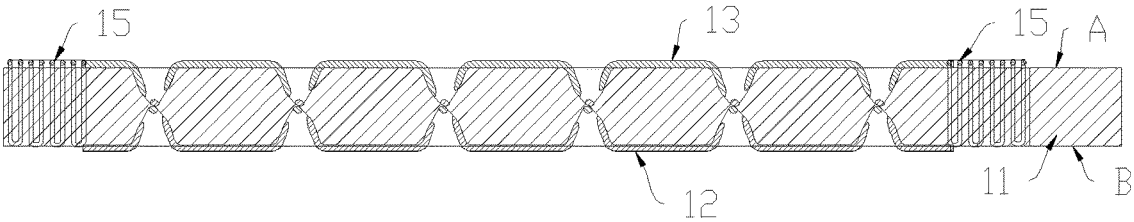
FIG. 2 is a sectional schematic diagram of the atomizing assembly where a first wire and a second wire thereof are interwoven.

As shown in FIG. 1 and FIG. 2, the atomizing assembly 10 includes a first liquid conducting member 11, a heating assembly and electrodes. The first liquid conducting member 11 is flexible. Generally, the first liquid conducting member 11 is provided with holes, or may be woven, and is configured to adsorb the atomizable medium. The heating assembly is fixed to the first liquid conducting member 11 through sewing.

The electrodes include a conductive electrode 15, which includes a conductive area 151 formed by sewing a conductive wire on the first liquid conducting member 11. The conductive area 151 is electrically connected to the heating assembly, to enable the heating assembly to generate heat when the electrodes are electrified, thereby atomizing the atomizable medium on the first liquid conducting member 11.

In some embodiments, the first liquid conducting member 11 includes an atomizing surface A and a liquid inlet surface B. Generally, the atomizing surface A and the liquid inlet surface B are located on two opposite sides of the first liquid conducting member 11, respectively. The atomizable medium enters the first liquid conducting member 11 from the liquid inlet surface B, and the adsorbed atomizable medium is heated to generate aerosol when the heating assembly is powered on, then the generated aerosol flows outward from the atomizing surface A by airflow, so that the liquid inlet and the atomization are not interfered. Preferably, the atomizing surface A is provided with a concave-convex structure that allows the heating assembly to be embedded in the surface of the first liquid conducting member 11, increasing the contact area between the heating assembly and the first liquid conducting member 11.

Figure 3:
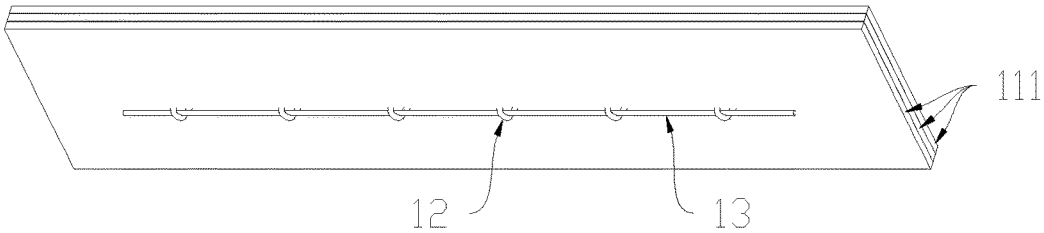
FIG. 3 is a three-dimensional schematic diagram of an atomizing assembly in another embodiment where a first liquid conducting member thereof includes three layers of liquid conducting layers, and a second wire thereof is flush with the atomizing surface on which it is located.
Figure 4:
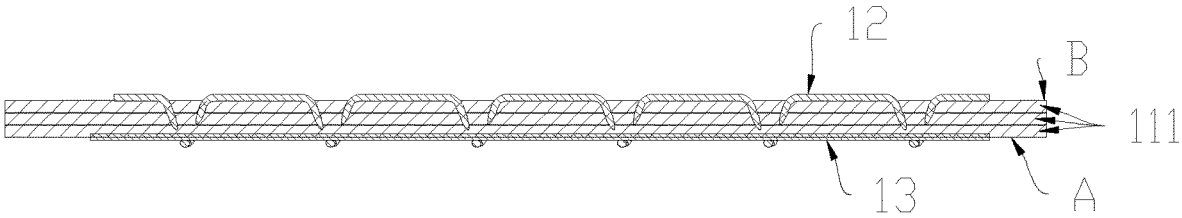
FIG. 4 is a sectional schematic diagram of the atomizing assembly in FIG. 3.

As shown in FIG. 3 and FIG. 4, the first liquid conducting member 11 may include one layer of liquid conducting layer 111, or may include more than one layer of liquid conducting layer 111 stacked in layers. When multiple layers of liquid conducting layers 111 are adopted, gaps are reserved between the various layers, which can store part of the atomizable liquid to improve the use effect. Meanwhile, the multi-layer first liquid conducting member 11 is sewn into a whole structure, which is also convenient for subsequent assembly. Further, the multi-layer structure may be made of different materials, so that some requirements can be taken into account, for example, the liquid inlet side needs to be made of a material with fast liquid conduction and good oil locking, and the part that is tightly attached to the second wire 13 for generating heat needs to be made of a material with a high-temperature resistant, while the problem can be well solved by adopting the multi-layer first liquid conducting member 11.

When the first liquid conducting member 11 is a multi-layer liquid conducting layer 111, the liquid conducting layer 111 of the atomizing surface A of the first liquid conducting member 11 may be made of one of the materials of linen cotton or aramid fiber woven fabric, or may be formed by weaving the above several materials, or may be made of some high-temperature resistant mixed materials.

In addition, when the first liquid conducting member 11 is a multi-layer liquid conducting layer 111, the liquid conducting layer 111 of the liquid inlet surface B of the first liquid conducting member 11 may be made of one or a combination of a non-woven fabric, a grating, and a mesh cotton. Further, the liquid inlet surface B is provided with grooves or mesh holes, so that the liquid conduction is faster, ensuring a timely liquid supply during atomization, and avoiding the dry burning due to insufficient liquid supply.

The first liquid conducting member 11 may be used in combination with other liquid conducting cotton. Preferably, the atomizing assembly 10 further includes a second liquid conducting member attached to the first liquid conducting member 11, and the second liquid conducting member is located on the side opposite the atomizing surface A.

The second liquid conducting member may be a liquid conducting cotton, a porous ceramic, or a liquid storage cotton or the like. The combined shape of the second liquid conducting member and the first liquid conducting member 11 may be a flat plate shape, or may be curled into a columnar shape, a tubular shape, or a curved shape.

Furthermore, as shown in FIG. 2, the heating assembly includes a first wire 12 and a second wire 13 that are flexible. Preferably, the second wire 13 is made of an electrically conductive material. The first wire 12 and the second wire 13 are respectively sewn onto the first liquid conducting member 11 from two opposite sides of the first liquid conducting member 11 and interwoven with each other, and are respectively fixed to the first liquid conducting member 11 from two sides.

Correspondingly, in the embodiment, the side where the second wire 13 is located is the atomizing surface A, and the side where the first wire 12 is located is the liquid inlet surface B. The atomizable medium enters the first liquid conducting member 11 from the side where the first wire 12 is located. When the second wire 13 made of a conductive material is energized, the adsorbed atomizable medium is heated to generate aerosol, which flows outward from the side where the second wire 13 is located under the action of the airflow. Of course, when the first wire 12 is made of a conductive material and the second wire 13 is made of a non-conductive material, the liquid inlet surface B and the atomizing surface A are exchanged. Or alternatively, both the first wire 12 and the second wire 13 are made of a conductive material, and both sides are atomized simultaneously, and the liquid may be entered from an end portion or a lateral side.

Further, in some embodiments, the first wire 12 may be made of a non-conductive material, and of course, the first wire 12 may also be made of a conductive material. When the first wire 12 is made of a conductive material, the resistance of the second wire 13 is less than the resistance of the first wire 12.

According to the sewing principle of a sewing machine, the first wire 12 and the second wire 13 with different resistances on the two sides are interwoven to form an integral structure with the first liquid conducting member 11. At least one of the first wire 12 and the second wire 13 can generate heat. The second wire 13 that can generate heat is fixed to the first liquid conducting member 11, which can ensure the contact between the second wire 13 and the first liquid conducting member 11, and is conducive to heating and atomizing, so that the problem of dry burning is avoided, and mass production can be realized.

According to the sewing principle of the sewing machine, one of the wires is changed into a heating wire that is electrically conductive, and the heating wire is fixed to the first liquid conducting member 11, so that the heating wire is assisted by an object and not easily separated from the liquid conducting member 11, meanwhile, large-batch production can be achieved, and the production cost is low.

Further, the heating assembly is fixed by sewing and has a good contact with the first liquid conducting member 11, so that the loosening is avoided. The first wire 12 and the second wire 13 can adopt thinner wires, and since the sectional areas of the first wire 12 and the second wire 13 can be smaller than that of the prior art, the thermal startup speed is fast, the heat dissipation is also fast, and a smaller power can be used to drive the atomizing assembly 10, which is more energy-saving. Large-batch larger-scale production is facilitated in the mode that the first wire 12 and the second wire 13 are interwoven after sewing. The wire-shaped process generally adopts a wire drawing forming through a die hole, and the sizes of the first wire 12 and the second wire 13 can be controlled accurately, which can make the resistance of the atomizing assembly 10 more stable.

Generally, the conductive material of the second wire 13 is one or a combination of a conductive metal alloy wire, a conductive metal fiber wire, a conductive carbon fiber wire, and a conductive graphite wire, which generates heat when the current is input, so that the second wire 13 generates heat when being energized. In some embodiments, the second wire 13 may adopt a round wire with the wire diameter ranging from 0.03 mm to 0.2 mm, such as 0.05 mm, 0.08 mm, 0.12 mm, 0.16 mm or the like, and preferably 0.11 mm, which is relatively proper in diameter and is not easy to break, and relatively thin and soft to be bent easily, and meanwhile, some requirements of the atomizing device on the resistance can be met. An optional material of the second wire 13 may be a metal material such as a nickel-based alloy, a stainless steel series alloy, a chromium-containing alloy, a titanium-containing alloy, a tungsten-containing alloy, a molybdenum-containing alloy, an iron-containing alloy, or a tin-containing alloy or the like, or may be a non-metallic conductive material such as a carbon fiber wire or a graphite fiber wire or the like, or may also be a filamentary shape twisted by one or two of an extremely fine conductive metal wire and an extremely fine conductive non-metallic wire. The conductive metal wire and the conductive non-metallic wire are relatively thin, and may be a fine wire with a diameter of several microns to tens of microns, which are not limited specifically.

The first wire 12 used to fix the second wire 13 has a wide range of material selection, which may be either a conductive material or a non-conductive material. The wire diameter of the first wire 12 also has a wide selection, and preferably is about 0.15 mm with a shape of a filament.

Specifically, the first liquid conducting member 11 is a liquid conducting cotton. After sewing, most of the second wire 13 is exposed on the atomizing surface A, and part of the second wire 13 is slightly sunken into the first liquid conducting member 11, so that the liquid on the surface of the first liquid conducting member 11 can be rapidly heated to the boiling point to generate atomized vapor when the two ends of the second wire 13 are energized.

When the second wire 13 is relatively soft in material or relatively thin in wire diameter, the interwoven position of the second wire 13 and the first wire 12 may be trapped in the first liquid conducting member 11 or may be flush with the surface of the first liquid conducting member 11.

Figure 5:
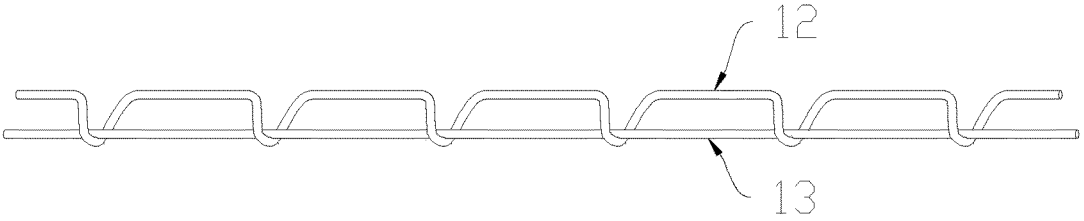
FIG. 5 is a schematic diagram showing a sewing route of the first wire and the second wire in FIG. 3.

Further, as shown in FIG. 3 to FIG. 5, when the second wire 13 has a thicker wire diameter, such as 0.15 mm or more, the second wire 13 may be flush with the surface of the first liquid conducting member 11 due to its high hardness and difficulty in bending. When the first wire 12 is a relatively soft wire, such as a cotton thread, a linen thread, an aramid fiber or other flexible wire, the second wire 13 may be flush with the surface of the first liquid conducting member 11 without being trapped in the first liquid conducting member 11, or may be slightly bent.

In some embodiments, the first wire 12 is made of a non-conductive material, and the atomizable medium enters the first liquid conducting member 11 from the side where the first wire 12 is located. Further, the non-conductive material of the first wire 12 may be cotton thread, flax, aramid fiber, glass fiber yarn, ceramic fiber yarn, or other material with a high temperature resistance, which is not limited herein.

In addition, in other embodiments, the first wire 12 may also be made of a conductive material, and the resistance of the second wire 13 is smaller than the resistance of the first wire 12. For example, when the atomizable medium is relatively viscous, the first wire 12 adopts a metal wire, such that the first wire 12 also generates heat, which is equivalent to preheating the e-liquid to a certain extent, thereby reducing its viscosity, and thus accelerating its flow speed.

Since most of the surface of the first wire 12 is trapped in the first liquid conducting member 11 or located at the liquid inlet surface B, and the first wire 12 is in contact with the second wire 13 of the first liquid conducting member 11, when the first wire 12 is made of a metal material, which means the first wire 12 and the second wire 13 are in a parallel state, and the heat generated by the first wire 12 in the direction close to the liquid inlet surface B can play a role in heating the e-liquid, which is equivalent to the effect of preheating.

The first wire 12 and the second wire 13 are arranged in parallel, so that the resistance of the second wire 13 needs to be smaller than the resistance of the first wire 12, making the power of the second wire 13 higher than that of the first wire 12. Due to the equal voltage of the parallel circuit, when the resistance of the second wire 13 is smaller than that of the first wire 12, the current flowing through the second wire 13 is larger than that of the second wire 13, and the temperature generated by the thermal effect of resistance of the first wire 12 is higher.

Figure 6:
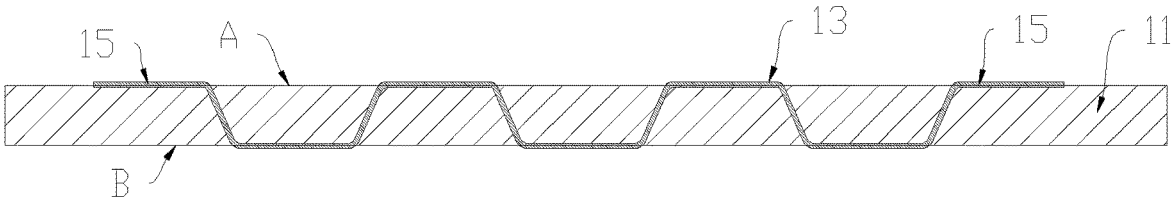
FIG. 6 is a schematic diagram of a heating assembly in another embodiment where a second wire is sewn in a cross stitch manner.

In other embodiments, as shown in FIG. 6, the first wire 12 may also be omitted and the second wire 13 may thread between the two opposite sides of the first liquid conducting member, with one of the two opposite sides being the liquid inlet surface B and the other of the two opposite sides being the atomizing surface A. In other embodiments, the second wire 13 may also thread between other different sides of the first liquid conducting member according to the position requirements of the liquid inlet and atomization.

Figure 7:
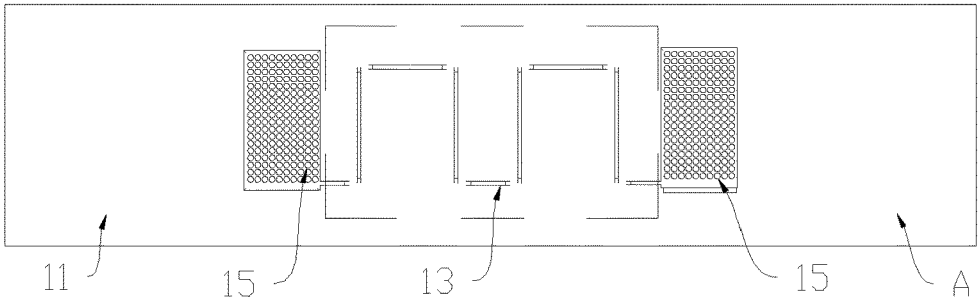
FIG. 7 is a schematic structural diagram where the conductive portions are arranged in a dotted mode.
Figure 8:
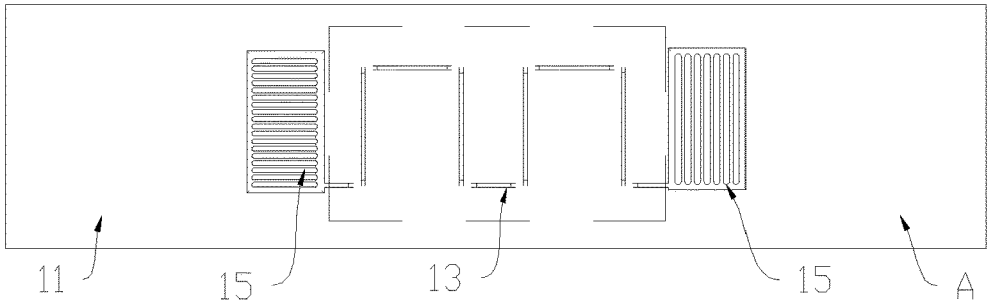
FIG. 8 is a schematic structural diagram where the conductive portions are linear shaped and arranged side by side.
Figure 9:
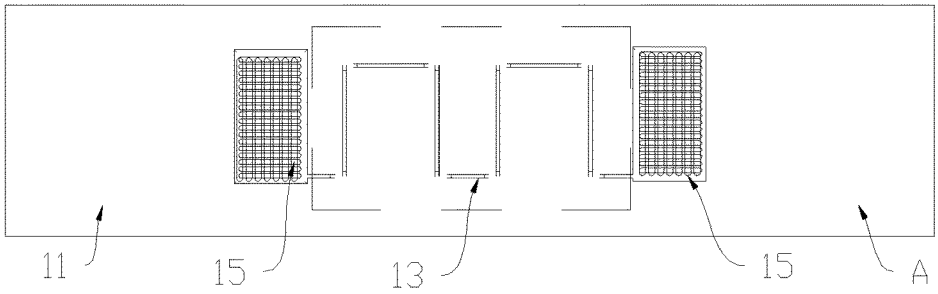
FIG. 9 is a schematic structural diagram where the conductive portions are linear shaped and cross arranged.

Generally, the electrodes include at least two conductive electrodes 15 that may be located on one side of the first liquid conducting member 11 or distributed on two sides of the first liquid conducting member 11. In some embodiments, as shown in FIG. 7 to FIG. 9, the conductive area 151 of the conductive electrode 15 is arranged with several conductive portions exposed and sewn by conductive wires. The conductive area 151 and the heating assembly are both sewn onto the first liquid conducting member 11, making the conductive electrode 15 less prone to detachment and preventing the heating assembly from detaching from the first liquid conducting member 11.

In some embodiments, as shown in FIG. 7, the conductive portions are dot shaped, and distributed in the conductive area 151, the dot-shaped conductive portions are closely arranged to facilitate the formation of a surface in contact with the outside. In other embodiments, the conductive portions are linear shaped, the conductive area 151 includes several conductive portions arranged side by side as shown in FIG. 8, or the linear-shaped conductive portions may also be cross arranged to form a mesh shape as shown in FIG. 9, to facilitate the formation of a surface in contact with the outside. Of course, the dot-shaped and linear-shaped conductive portions may also be combined arranged, and the dot-shaped conductive portions may be filled in the gaps formed by the intersection of the linear-shaped conductive portions, to improve the contact surface.

In some embodiments, the number of the exposed linear-shaped conductive portion of the conductive area 151 may also be only one, and then the external circuit is pressed through an elastic electrode or the like onto the conductive area to contact the linear-shaped conductive portion, to achieve conductive contact with this linear conductive portion.

In some embodiments, the second wire 13 and the conductive wire are made of the same material, and the problem of wire changing can be avoided during the sewing. Preferably, the second wire 13 and the conductive wire are a same wire, so that the sewing of the heating assembly and the conductive area 151 can be completed through one-time wiring without changing the wire midway, resulting in a higher efficiency. Of course, in other embodiments, the second wire 13 and the conductive wire may also be made of different material, the conductive wire may be made of a material with better conductivity, and the second wire 13 and the conductive wire are mutually connected and conducted after being sewn separately.

The conductive electrode 15 further includes a support layer 152 that supports the conductive portion, and a conductive layer 153 arranged on the conductive area 151. The support layer 152 can prevent the conductive wire from getting trapped in the first liquid conducting member 11 to result in a small contact area with the outside, thereby affecting the conductive effect. The conductive layer 153 is electrically conductive to the conductive portion of the conductive area 151, so that the conductive electrode 15 is in contact conduction with the outside through the conductive layer 153, making the contact more stable.

Figure 10:
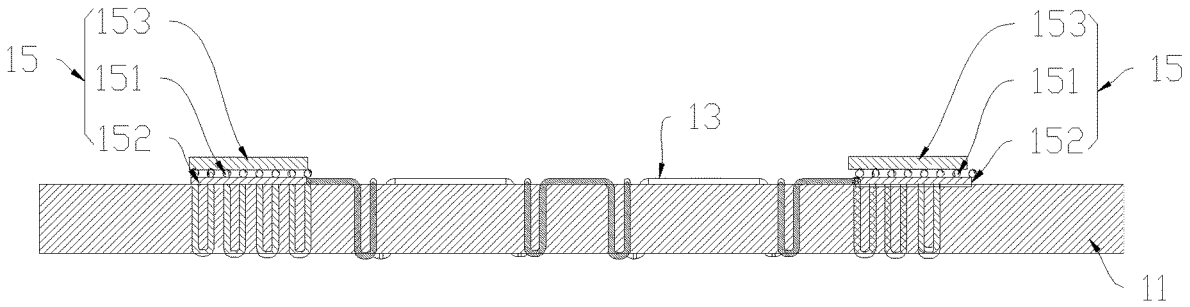
FIG. 10 is a schematic diagram where a conductive electrode includes a conductive area, a support layer, and a conductive layer.

Further, as shown in FIG. 10, in this embodiment, the support layer 152 is arranged between the conductive portion and the first liquid conducting member 11 to provide support for the conductive portion. Preferably, the support layer 152 is made of a conductive metal, and may be made of a thin metal sheet with relatively good conductivity, such as copper, aluminum, nickel, or other metal sheet. Generally, the thickness of the support layer 152 is 0.2 mm or less. The support layer 152 also serves to provide a support force when the electrode is in contact with the outside. For example, when the conductive electrode 15 comes into contact with an external contact, the conductive electrode 15 needs to be pressed to reduce the contact resistance. Since the conductive electrode 15 is attached to the first liquid conducting member 11 which is relatively soft, the first liquid conducting member 11 can not resist the force and is prone to being compressed when the external contact is pressed, which may lead to the contact position not tight enough to result in a high contact resistance. By arranging the metal layer, a better support can be provided, thereby avoiding the contact point being compressed without being supported.

Figure 11:
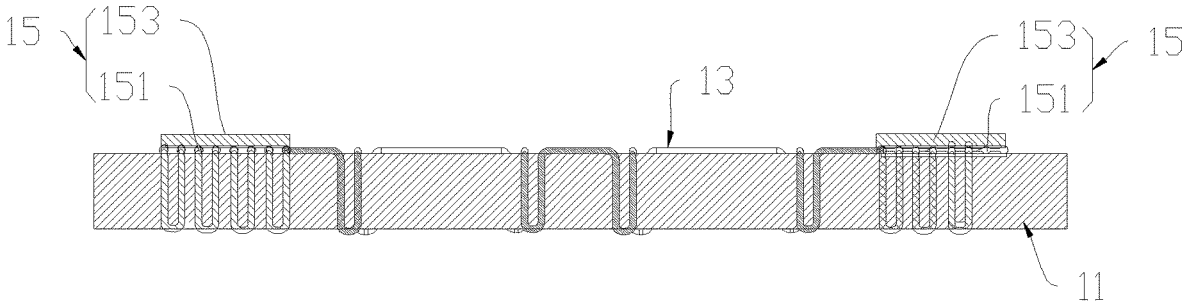
FIG. 11 is a schematic diagram where a conductive electrode includes a conductive area and a conductive layer.

Of course, as shown in FIG. 11, in other embodiments, when the conductive portion is not trapped by changing the sewing method or the hardness of the conductive wire, the support layer 152 may also be omitted; or, when the conductive portion is relatively flat under the support of the support layer 152, the conductive layer 153 may also be omitted.

Figure 12:
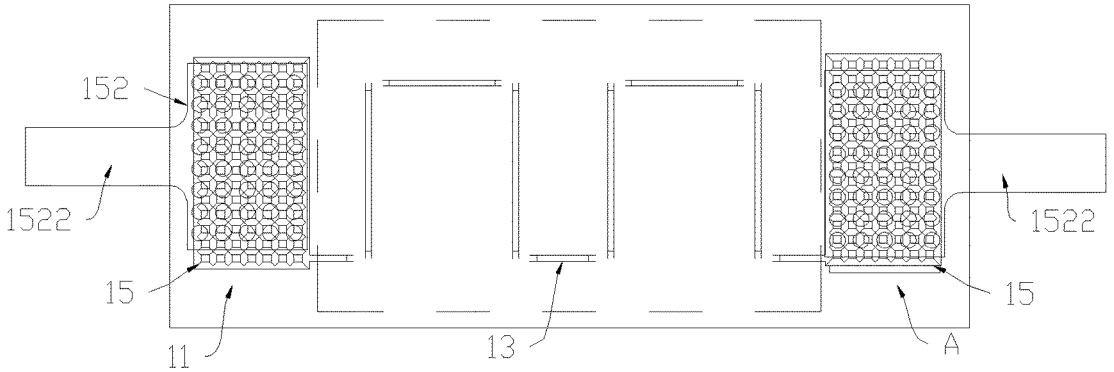
FIG. 12 is a schematic diagram where a support layer of a conductive electrode includes a conductive head.
Figure 13:
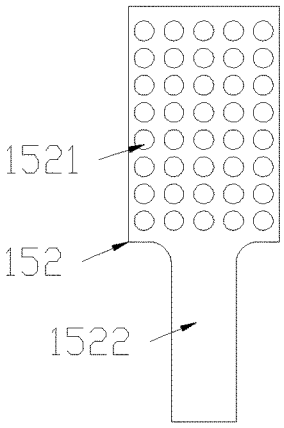
FIG. 13 is a schematic diagram of the support layer in FIG. 12.

As shown in FIG. 12 and FIG. 13, the support layer 152 is provided with positioning holes 1521 for the conductive wire to pass through to be sewn to the first liquid conducting member 11, so that the support layer 152 can be arranged more stably and quickly, and the support layer 152 is fixed to the first liquid conducting member 11 through the conductive wire.

In addition, the conductive layer 153 with a lower resistivity may be further formed on the surface of the exposed conductive portion to reduce contact resistance. The conductive portion is thus sandwiched between the support layer 152 and the conductive layer 153, making the contact more reliable. The conductive layer 153 is formed by coating or printing a conductive paste or a conductive adhesive. It can be understood that in other embodiments, the conductive layer 153 may also be a metal sheet attached to the conductive electrode. The material of the metal sheet may be nickel, stainless steel, copper, aluminum foil, or the like. Then the metal sheet may be punctured and sewn to the first liquid conducting member 11, so that the metal sheet and the first liquid conducting member 11 are fixed and compounded together. The advantage is that the electrode part will have a certain hardness, making it more convenient to contact an external electrode of the atomizer.

Further, the support layer 152 may be composed of a metal sheet with relatively small electrical resistivity, such as copper-containing metal, iron-containing metal, aluminum-containing metal, nickel-containing metal, silver-containing metal, or other metal sheet. An edge of the support layer 152 extends outward to form a conductive head 1522. The conductive head 1522 is in contact with an external contact, or is welded to the outside, or is welded to a soft lead to be connected to an external electrode. The extension direction of the conductive head 1522 can be arranged as needed to meet the installation requirements of different conductive positions. When the conductive head 1522 is arranged, the conductive layer 153 may also be omitted, and of course, the conductive head 1522 and the conductive layer 153 may also exist simultaneously.

Further, the present invention provides a manufacturing process of the atomizing assembly in another embodiment, including the following steps:

providing a flexible liquid conducting substrate and a flexible conductive wire; and sewing the conductive wire onto the liquid conducting substrate to form the conductive area 151 configured to electrically conduct an external power and the heating assembly.

From the previous content, the conductive wire of the conductive area 151 and the second wire 13 of the heating assembly may be the same wire, so that the conductive area 151 and the heating assembly can be completed in one step.

Preferably, in order to provide a support for the conductive area 151, ensure its flatness, and avoid being trapped in the first liquid conducting member, a support layer 152 may be arranged on the liquid conducting substrate, and then sewing on the support layer 152 to form the conductive area 151, allowing the support layer 152 to support the conductive area 151.

Further, the support layer 152 is provided with positioning holes 1521 for the conductive wire to pass through to be sewn onto the liquid conducting substrate, so that the support layer 152 is sewn onto the liquid conducting substrate by the conductive wire, to position the support layer 152, and provide support for the conductive area 151.

In some embodiments, in order to make the contact surface between the conductive area 151 and the outside smoother and the contact stable, a conductive layer 153 is arranged on the conductive area 151. The conductive layer 153 covers the conductive area 151, then the conductive layer 153 is electrically conducted to an external contact to avoid poor contact due to the softness of the liquid conducting substrate.

Further, the conductive layer 153 may be formed by coating or printing a conductive paste or a conductive adhesive on the conductive area 151; or, the conductive layer 153 may be formed by sewing a metal sheet onto the liquid conducting substrate.

Figure 14:
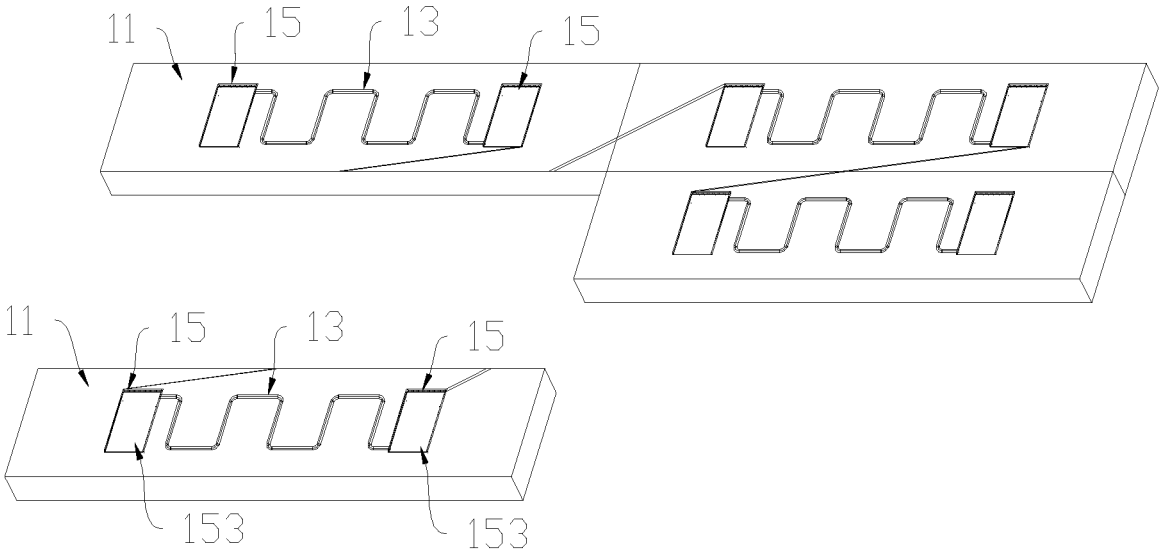
FIG. 14 is a schematic diagram of atomizing assemblies formed by cutting after a first wire, a second wire, and conductive electrodes are sewn on a liquid conducting material.

Further, as shown in FIG. 14, if the size of the liquid conducting substrate is small, the liquid conducting substrate may be the first liquid conducting member 11, and the electrodes and the heating assembly are arranged on the first liquid conducting member 11. Or, multiple sets of heating assemblies and electrodes may be sewn on a large liquid conducting substrate in a zoned manner in advance, and preferably, the multiple sets of heating assemblies and electrodes are sewn at one time, and the circuits in various zones are connected. After the sewing is completed, the liquid conducting substrate is cut to form a plurality of atomizing assemblies with heating assemblies and electrodes.

The above conductive area 151 of the conductive electrode of the atomizing assembly 10 can be manufactured to the first liquid conducting member 11 in a sewing manner, and the structure of the atomizing assembly 10 has the following advantages: the production is relatively simple and easy to implement, the electrically conductive material is fixed on the liquid conducting substrate based on the sewing principle, to form the atomizing assembly with good reliability, easy to batch production, and having good contact between the heating assembly and the liquid conducting substrate, and the problems that in the application of the flexible liquid conducting substrate such as the liquid conducting cotton, the electrode is prone to poor contact and deformation, difficult to take during assembly, and prone to disconnect after being welded, are solved.

It is understood that the above-mentioned technical features can be used in any combination without limitation.

While the present invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the present invention refer to an embodiment of the present invention and not necessarily all embodiments.

What is claimed is:

1. An atomizing assembly, comprising a first liquid conducting member (11) and at least one electrode;

wherein the first liquid conducting member (11) is flexible and configured for adsorbing an atomizable medium, wherein the at least one electrode comprises a conductive electrode (15) comprising a conductive area (151) formed by sewing a conductive wire on the first liquid conducting member (11), and wherein the conductive area (151) is electrically connected to a heating assembly to enable the heating assembly to heat and atomize the atomizable medium on the first liquid conducting member (11) when electrified; the conductive area (151) is arranged with several conductive portions exposed after sewing the conductive wire, wherein the conductive portions are dot shaped, and distributed in the conductive area (151); and/or, the conductive portions are linear shaped, and the conductive area (151) comprises the several conductive portions arranged side by side or in a crossed manner;

the conductive electrode (15) further comprises a support layer (152) supporting the conductive portion;

the support layer (152) is made of a conductive metal, and the support layer (152) is provided with positioning holes (1521) for the conductive wire to pass through to be sewn to the first liquid conducting member (11).

2. The atomizing assembly of claim 1, wherein the conductive area (151) is provided with at least one linear-shaped conductive portion exposed after sewing the conductive wire.

3. The atomizing assembly of claim 1, wherein the support layer (152) is arranged between the conductive portion and the first liquid conducting member (11).

4. The atomizing assembly of claim 1, wherein an edge of the support layer (152) extends to form a conductive head (1522) for electrical conduction.

5. The atomizing assembly of claim 1, wherein the conductive electrode (15) further comprises a conductive layer (153) arranged on the conductive area (151).

6. The atomizing assembly of claim 5 wherein the conductive layer (153) is made of a conductive paste or a conductive adhesive; or, the conductive layer (153) is made of a metal sheet sewn onto the first liquid conducting member (11).

7. The atomizing assembly of claim 1, wherein the at least one electrode comprises at least two conductive electrodes (15) that are located on one side of the first liquid conducting member (11) or on two sides of the first liquid conducting member (11).

8. The atomizing assembly of claim 1, wherein the atomizing assembly further comprises a heating assembly fixed to the first liquid conducting member (11) by sewing.

9. The atomizing assembly of claim 8, wherein the heating assembly comprises a second wire (13) that is flexible and sewn on the first liquid conducting member (11), wherein the second wire (13) is electrically conductive, and electrically connected to the conductive area (151), and wherein a sewing density of the heating assembly is less than a sewing density of the conductive area (151).

10. The atomizing assembly of claim 9, wherein the material of the second wire (13) is the same as that of the conductive wire; or, the second wire (13) and the conductive wire are a same wire.

11. An atomizing device, comprising:

the atomizing assembly (10) of claim 1.

12. A manufacturing process of an atomizing assembly, comprising:

providing a liquid conducting substrate that is flexible and a conductive wire that is flexible; and sewing the conductive wire onto the liquid conducting substrate to form a conductive area (151) configured to electrically conduct an external power and a heating assembly;

wherein a conductive layer (153) is arranged on the conductive area (151); a conductive layer (153) is arranged on the conductive area (151); the conductive layer (153) is formed by coating or printing a conductive paste or a conductive adhesive on the conductive area (151); or, the conductive layer (153) is formed by sewing a metal sheet onto the liquid conducting substrate.

13. The manufacturing process of the atomizing assembly of claim 12, wherein after a support layer (152) is arranged on the liquid conducting substrate, the conductive area (151) is formed by sewing on the support layer (152).

14. The manufacturing process of the atomizing assembly of claim 13, wherein the support layer (152) is provided with positioning holes (1521), and wherein the conductive wire is sewn onto the liquid conducting substrate through the positioning holes (1521), and positions the support layer (152).

15. The manufacturing process of the atomizing assembly of claim 12, wherein multiple sets of heating assemblies and electrodes are sewn on the liquid conducting substrate in a zoned manner, and then the liquid conducting substrate is cut to form the atomizing assembly respectively with the heating assembly and the electrode.

* * * * *